US010934043B2

(12) United States Patent
Peccetti

(10) Patent No.: US 10,934,043 B2
(45) Date of Patent: Mar. 2, 2021

(54) CUTTING METHOD AND UNIT IN A PACKAGING MACHINE IN EXTENSIBLE FILM

(71) Applicant: Colines S.p.A., Novara (IT)

(72) Inventor: Francesco Peccetti, Sizzano (IT)

( * ) Notice: Subject to any disclaimer, the term of this patent is extended or adjusted under 35 U.S.C. 154(b) by 218 days.

(21) Appl. No.: 16/067,038

(22) PCT Filed: Feb. 7, 2017

(86) PCT No.: PCT/EP2017/052663

§ 371 (c)(1),
(2) Date: Jun. 28, 2018

(87) PCT Pub. No.: WO2017/137403

PCT Pub. Date: Aug. 17, 2017

(65) Prior Publication Data

US 2019/0055044 A1 Feb. 21, 2019

(30) Foreign Application Priority Data

Feb. 9, 2016 (IT) ..... IT102016000012977

(51) Int. Cl.
*B65B 61/06* (2006.01)
*B65B 11/00* (2006.01)
(Continued)

(52) U.S. Cl.
CPC ..... *B65B 61/06* (2013.01); *B65B 11/008* (2013.01); *B65B 11/58* (2013.01); *B65B 21/245* (2013.01); *B65B 61/10* (2013.01)

(58) Field of Classification Search
CPC ..... B65B 11/58; B65B 21/245; B65B 61/06; B65B 61/10
See application file for complete search history.

(56) References Cited

U.S. PATENT DOCUMENTS 3,758,366 A * 9/1973 Ballestrazzi ..... B29C 66/8225 156/515
3,782,070 A * 1/1974 Erlandson ..... B65B 9/06 53/557

(Continued)

FOREIGN PATENT DOCUMENTS

EP 0304979 3/1989
WO 2015040565 3/2015

*Primary Examiner* — Thanh K Truong
*Assistant Examiner* — David G Shutty
(74) *Attorney, Agent, or Firm* — Themis Law

(57) ABSTRACT

A cutting method in a packaging machine using extensible film includes feeding products, wound in a continuous packaging or in a bundle of products, to a cutting unit; cutting the continuous packaging into finished groups of products using a movable cutting device that advances with the packaging to be cut and makes a transversal cut along the perimeter of the packaging; and bringing the movable cutting device back and performing a new cutting step simultaneously in two points of the packaging spaced from each other, with two vertical sections cut at a first point and two horizontal sections are cut at a second point to create a finished packaging. The packaging machine includes a cutting device, a slide moving forward and backward, and a side cutting device and an upper and lower cutting device spaced apart and acting simultaneously on the packaging to cut in two points vertically and horizontally.

8 Claims, 8 Drawing Sheets

(51) Int. Cl.

| | |
|---|---|
| ***B65B 11/58*** | (2006.01) |
| ***B65B 21/24*** | (2006.01) |
| ***B65B 61/10*** | (2006.01) |

(56) References Cited

U.S. PATENT DOCUMENTS

| | | | | | |
|---|---|---|---|---|---|
| 4,050,220 | A * | 9/1977 | Lancaster | B65B 11/008 | 53/556 |
| 4,083,163 | A * | 4/1978 | Ganz | B65B 21/245 | 53/210 |
| 4,218,863 | A * | 8/1980 | Howard | B29C 65/10 | 53/547 |
| 4,549,388 | A * | 10/1985 | Lancaster | B65B 51/225 | 53/210 |
| 4,738,079 | A * | 4/1988 | Lancaster | B26D 5/20 | 53/389.3 |
| 4,881,357 | A * | 11/1989 | Ballestrazzi | B65B 59/001 | 53/64 |
| 4,953,336 | A * | 9/1990 | Lancaster | B65B 11/008 | 53/176 |
| 5,531,061 | A * | 7/1996 | Peterson | A01F 15/071 | 53/133.8 |
| 6,745,544 | B2 * | 6/2004 | Matsumoto | B65B 11/006 | 53/176 |
| 7,398,630 | B2 * | 7/2008 | Kovacs | B65B 9/067 | 198/461.1 |
| 9,284,105 | B2 * | 3/2016 | Ghezzi | B65B 21/245 | |
| 10,597,181 | B2 * | 3/2020 | Cattaneo | B65B 11/008 | |
| 2008/0047232 | A1 | 2/2008 | Kovacs | | |

* cited by examiner

CUTTING METHOD AND UNIT IN A PACKAGING MACHINE IN EXTENSIBLE FILM

FIELD OF THE INVENTION

The present invention relates to a cutting method and unit in a packaging machine in extensible film. In the packaging field of various types of products such as, for example, bottles, boxes having varying formats, etc., a film made of heat-shrinkable plastic material is currently most commonly used. After being wound around the product or group of products, this film provides that a cutting and welding device separates a single packaging which is subsequently treated in a heat-shrinking oven which stabilizes the packaging so as to stably withhold the products contained therein.

BACKGROUND OF THE INVENTION

The use of a cutting and welding device of the type indicated above entails that the product or group of products being packaged be spaced inside the film, before being welded and cut. Furthermore, it requires the use of film having a certain cost as the plastic material to be used must have a certain thickness and must then undergo heat-shrinking.

A further problem is connected to the times for reaching the finished packaging of products as the products or groups of products are spaced in order to be packaged in the manner described above.

If, alternatively, a film of extensible plastic material is used, which is spirally wound around the products that are moved forwards according to a horizontal direction, the cutting step is currently always effected with cutting devices of the cutting and welding type indicated above. These cutting devices do not involve rapid intervention times.

If, on the one hand, packaging in film of extensible plastic material eliminates the necessity of a heat-shrinking oven and the relative energy costs and also allows the use of a thinner film, the current cutting and welding device is not satisfactory as it considerably slows down the packaging.

WO 2015/040565 discloses equipment used for the packaging of bottles with a thin film made of extensible plastic material which is spirally wound around the bottles fed consecutively in continuous. The equipment has a cutting station on a slide which intervenes to effect cuts on the bundle thus formed.

SUMMARY OF THE INVENTION

The general objective of the present invention is to provide a cutting method and unit in a packaging machine of products in extensible film, that is capable of solving the drawbacks of the known art indicated above in an extremely simple, economical and particularly functional manner.

A further objective of the present invention is to provide a cutting method and unit in a packaging machine that can eliminate slowdowns in the packaging, increasing the production of finished packagings.

Another objective of the present invention is to provide a cutting unit in a packaging machine of products in an extensible film that is capable of reducing the costs relating to the packaging material.

BRIEF DESCRIPTION OF THE DRAWINGS

The structural and functional characteristics of the present invention and its advantages with respect to the known art will appear even more evident from the following description, referring to the enclosed schematic drawings, which show an embodiment example of the same invention. In the drawings.

DETAILED DESCRIPTION OF EMBODIMENTS OF THE INVENTION

With reference to the figures, these show a final portion of a packaging machine of products 11 using extensible film, such as bottles or other objects, wherein the use of a cutting unit according to the present invention is provided.

A first observation to be made is that a cutting unit according to the invention is particularly useful when the products are fed forwards in continuum juxtaposed one after another. In the case of bottles, for example, said bottles are fed in pairs adjacent to each other and moved forwards on a feed conveyor.

Said products 11, moreover, are contained, for example, wound in an extensible film in an intersection of layers of film spirally arranged to stabilize the packaging when finished, wherein said layers of film are superimposed and wound according to two opposite rotation directions. Alternatively, the film can also be traditionally arranged starting from a centre-folded film with the aid of devices that keep the film stably in a continuous packaging around the products contained therein.

Figure 1:
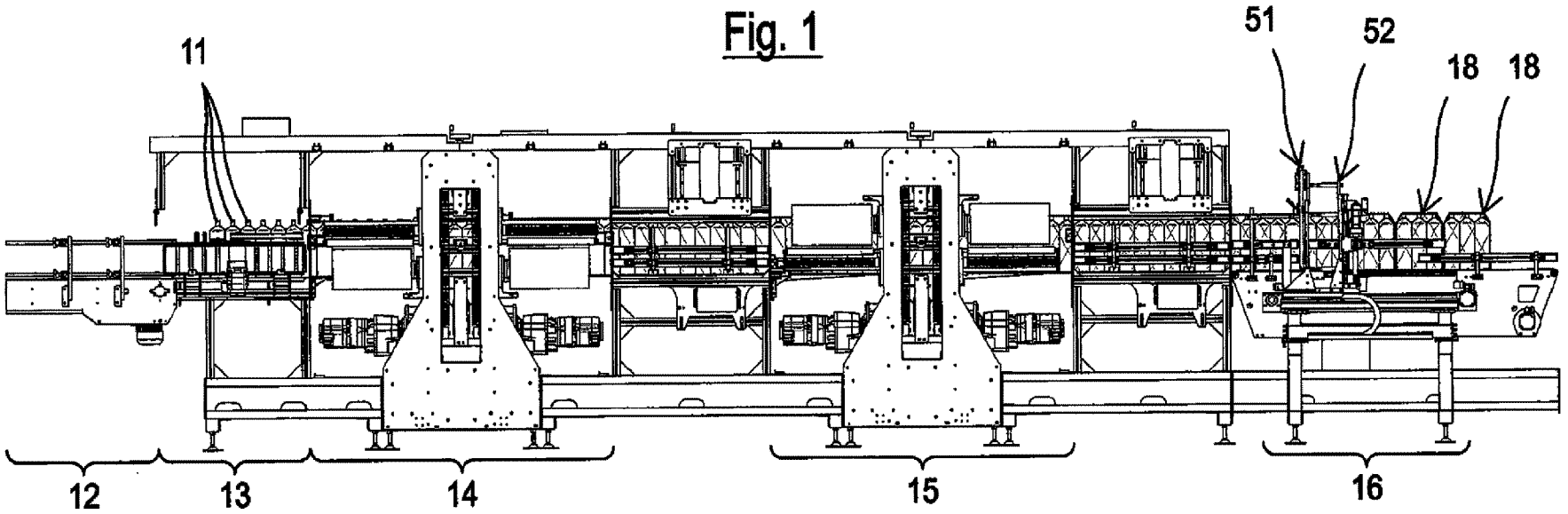
FIG. 1 is a raised side view illustrating a packaging machine of products in extensible film in which a cutting unit according to the invention is provided.
Figure 2:
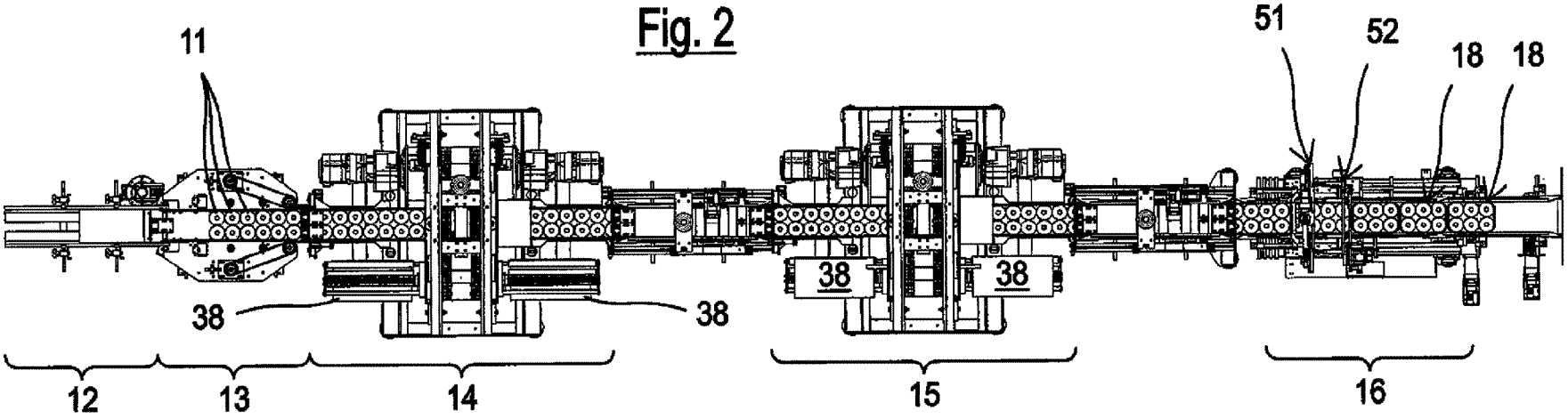
FIG. 2 is a plan view from above of the packaging machine of products in extensible film of FIG. 1 provided with the cutting unit according to the present invention.
Figure 3:
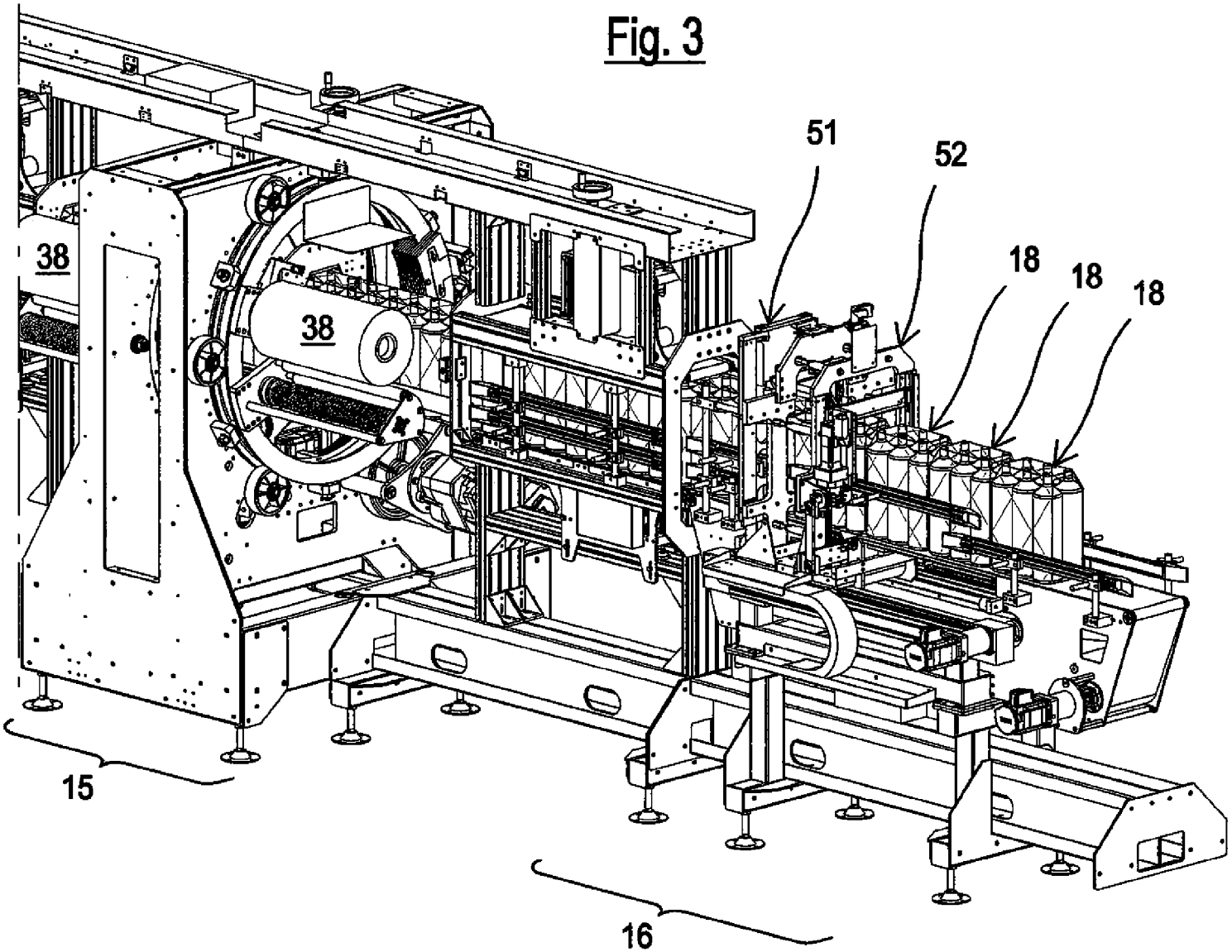
FIG. 3 is a perspective view of the cutting unit according to the present invention.
Figure 4:
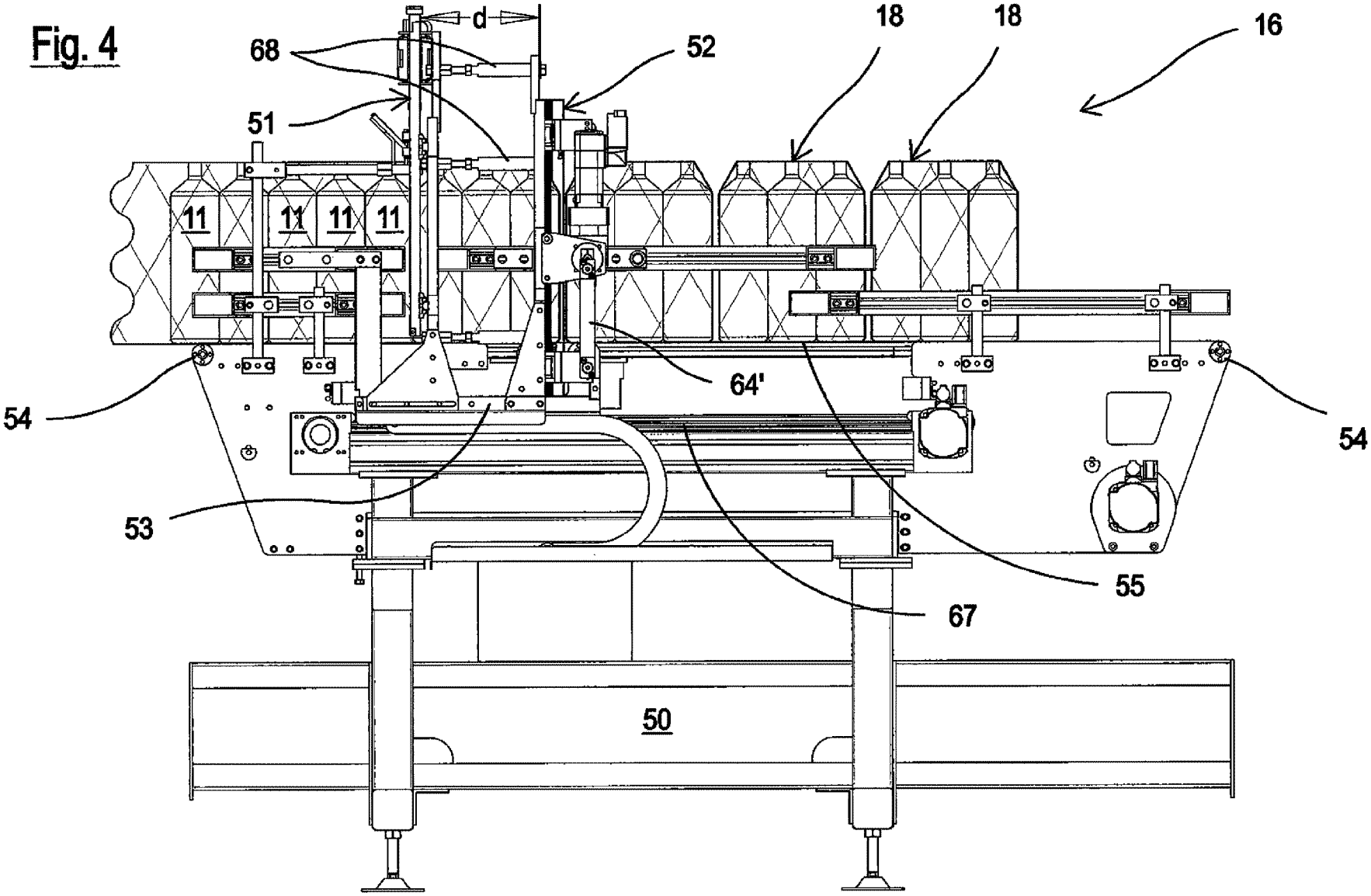
FIG. 4 is a raised side view showing the whole cutting unit forming part of the machine of FIG. 1.
Figure 5:
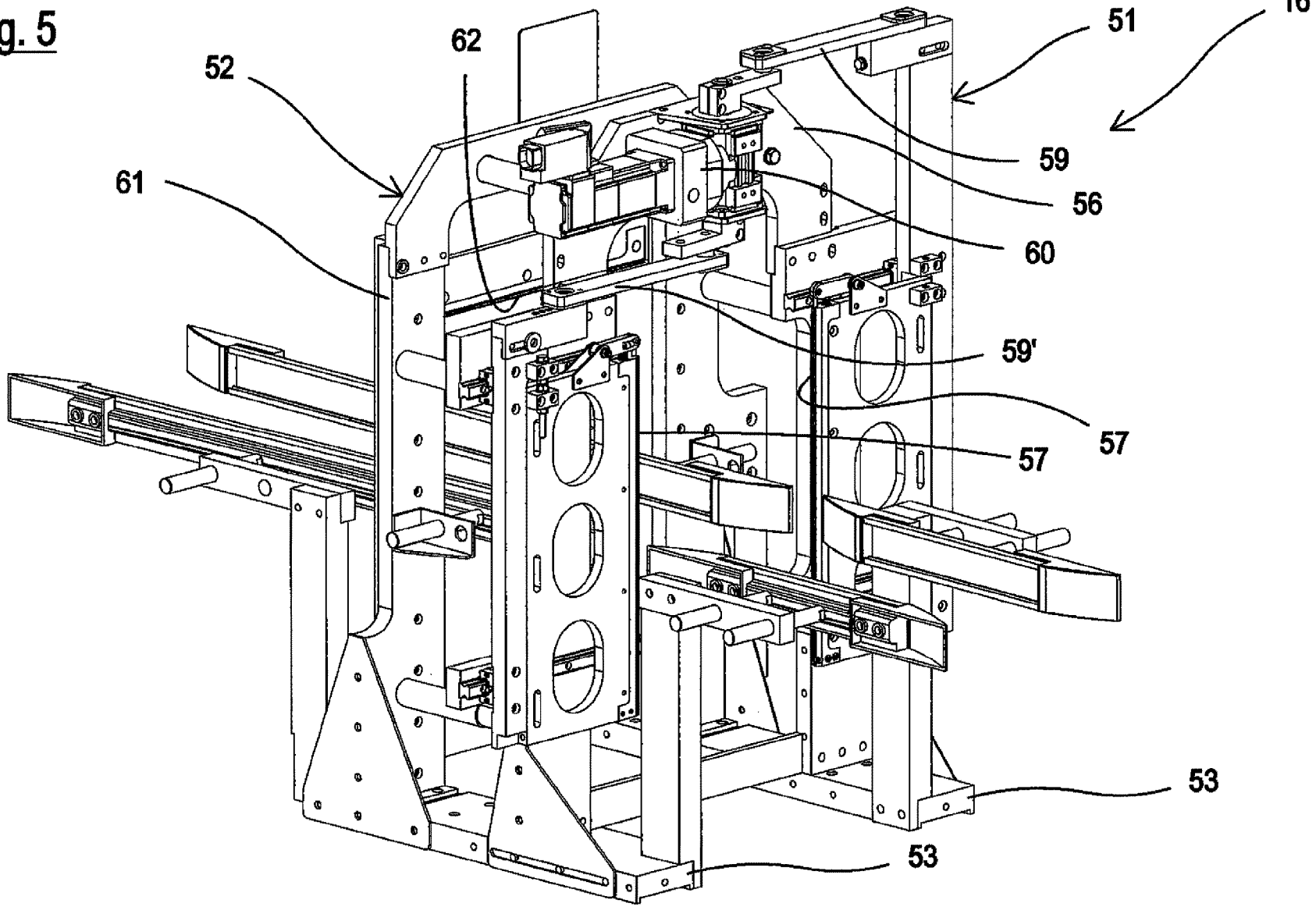
FIGS. 5 and 6 are perspective views of part of the cutting unit shown in FIG. 4.
Figure 6:
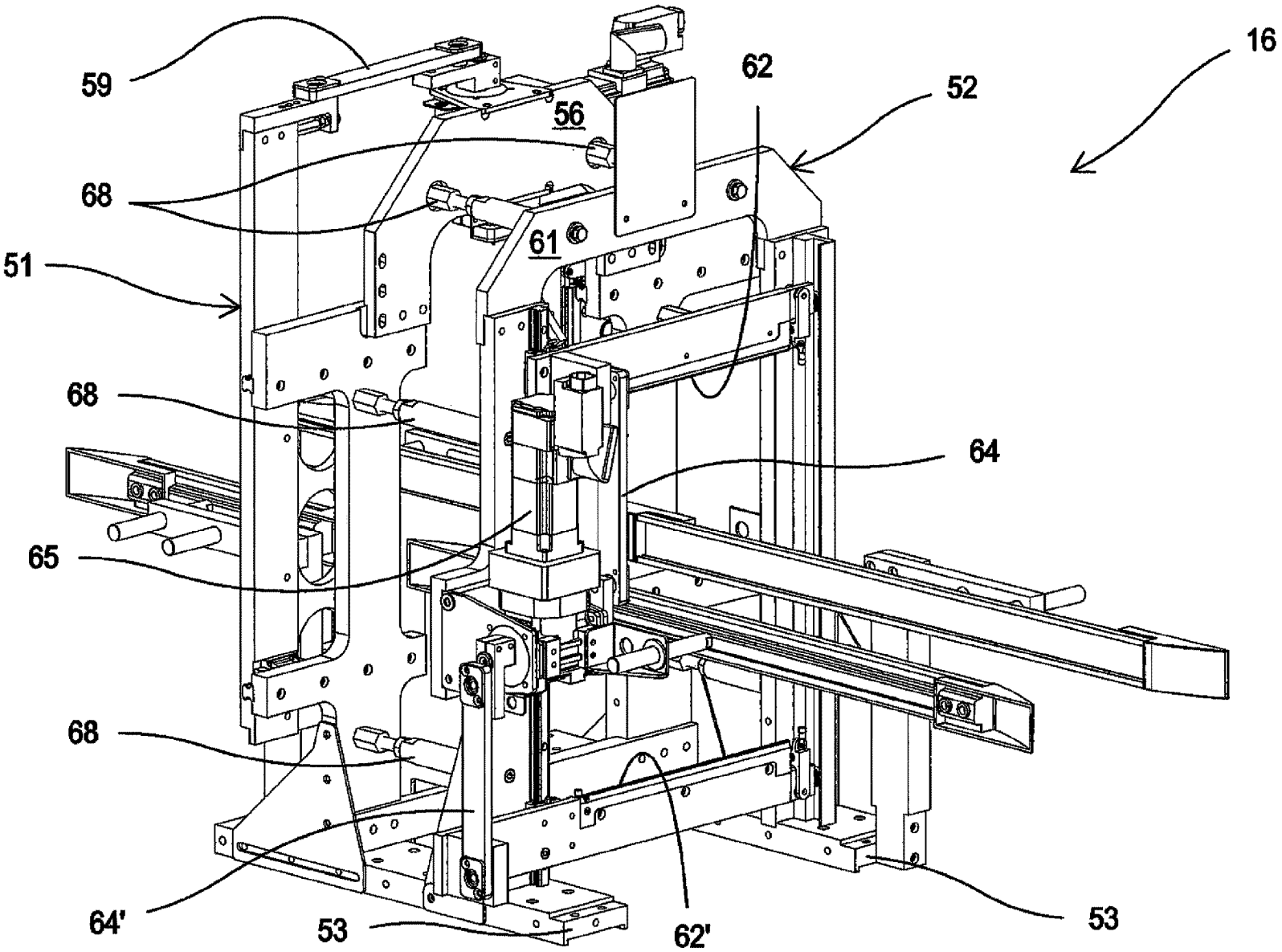
Figure 7:
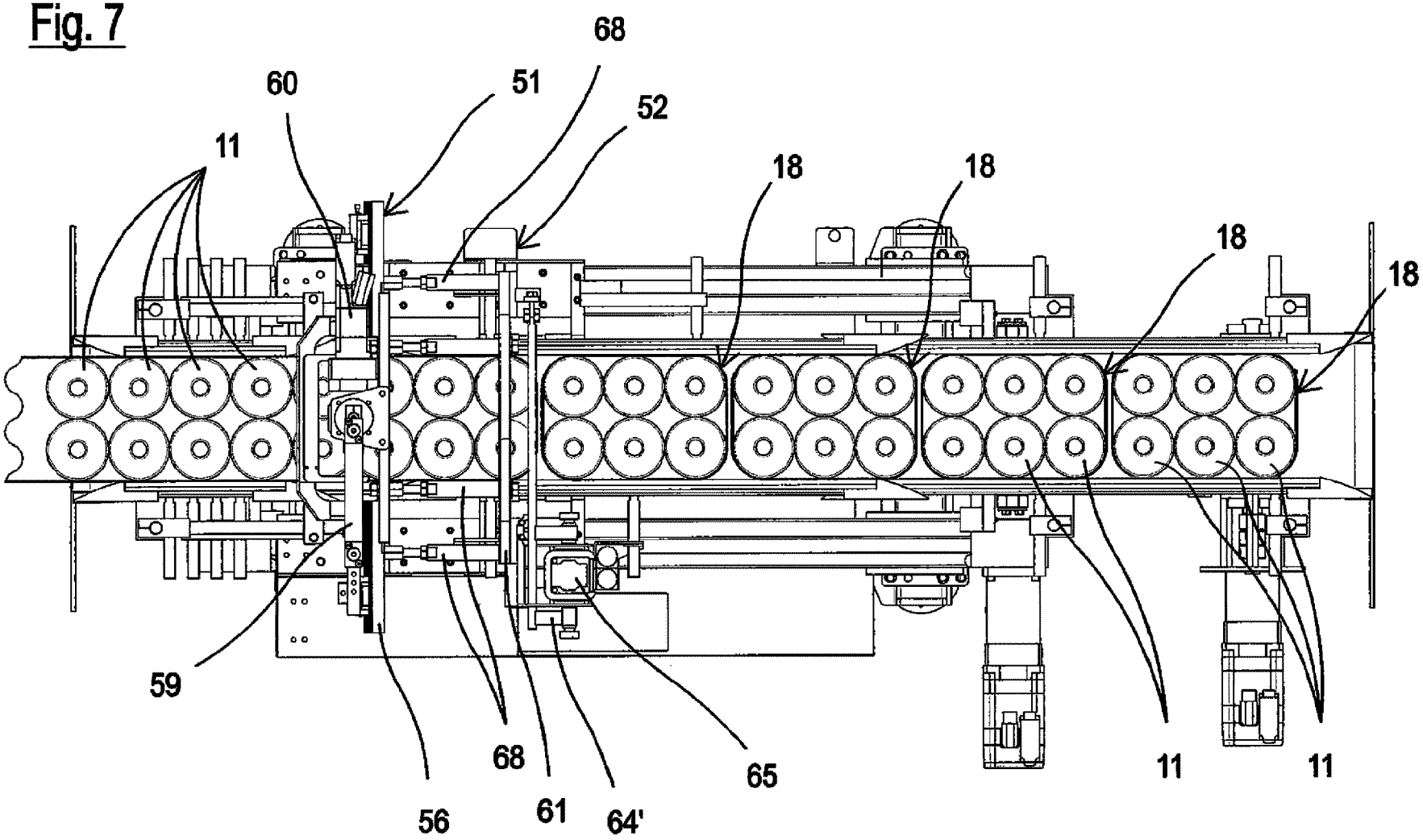
FIG. 7 is a plan view from above of the cutting unit of the previous FIGS. 4-6.

In the application example illustrated in FIGS. 1 and 2, a packaging machine is shown, which comprises an ordering unit 13 that receives two continuous rows of adjacent bottles 11 from a conveyor belt 12 and keeps them thus ordered up to a first ring winding unit 14. The first ring winding unit 14 is then followed by a second ring winding unit 15, opposite the first unit 14, which effects a winding in an opposite direction with respect to the first winding unit 14 to produce a continuous packaging or bundle. The second winding unit 15 is in turn followed by a cutting unit 16 according to the invention, that separates the continuous packaging into finished groups of products 11, wound in the film of extensible plastic material and forming a final packaging 18.

As already indicated, a cutting unit 16 according to the invention must intervene in a packaging machine to separate a series of finished packagings 18 of a predetermined number of products 11 from a continuous packaging or bundle being fed forwards. In the figures, for example, this is effected to separate finished packagings 18, for example six bottles 11 in two adjacent pairs, from a continuous packaging or bundle moving forwards.

The cutting unit 16 comprises a frame 50 which supports a side cutting device 51 and an upper and lower cutting device 52. According to the invention, in fact, the cutting unit 16 acts on the plastic material of continuous packaging wound around the bottles 11 to effect a transversal cutting of the perimeter of the continuous packaging or bundle that is moving forwards. The cutting is composed of four sections of the packaging, two vertical and two horizontal, which in fact form the perimeter of the continuous packaging or bundle.

The frame 50 carries a slide 53, free to move forwards and backwards, bearing the side cutting device and the upper and lower cutting device 52 on relative guides 67. Said slide 53 moves forwards and backwards beneath a conveyor belt 55 whose upper part is designed for being wound around end pulleys 54. The conveyor belt 55 supports the various pairs of bottles 11 previously arranged in the film to form the above-mentioned continuous packaging bundle which arrives wound in two layers of film, arranged spirally crossed while moving forwards. The conveyor belt 55 consequently accompanies the various pairs of bottles wound in the single packaging or continuous bundle during the complete cutting step.

The side cutting device 51 provides a portal 56 containing two vertical side blades 57 movably positioned on horizontal guides 58 for moving forwards and backwards. In this way, the two vertical side blades 57 can be moved towards and away from the tubular plastic material wound around the bottles 11 to effect a cutting on two vertical sections of said continuous packaging on opposite sides of said continuous packaging or bundle. The vertical blades 57 are operatively subjected to a voltage difference and heated by the current which is consequently generated and passes through them thus operating with a hot cut or in any case with alternative systems such as ultrasounds, etc. The portal 56 is positioned astride on the continuous packaging or bundle of products 11 that moves forwards inside said cutting unit.

The two vertical blades 57 are driven in this movement by a double crank mechanism 59, 59', upper and lower, actuated by a single motor 60.

The upper and lower cutting device 52 also provides a portal 61 containing two upper 62 and lower 62' horizontal blades movably positioned on horizontal guides 63 for moving forwards and backwards on a vertical plane. In this way, the two horizontal blades 62, 62' can be moved towards and away from the continuous packaging or bundle comprising two layers of film wound in an opposite direction around the products to effect a cutting on two horizontal sections of said continuous packaging on opposite sides of the continuous packaging or bundle. Also in this case, the two horizontal blades 62, 62' are operatively subjected to a voltage difference and heated by the current which is consequently generated and passes through them therefore operating with a hot cut or in any case with alternative systems such as ultrasounds, etc.

The two horizontal blades 62, 62' are driven in this movement by a double crank mechanism 64, 64', upper and lower, actuated by a single motor 65.

Furthermore, the lower blade 62' in its forward and backward, upward and downward movement moves in an omega-shaped loop formed in the belt 55, wherein said omega-shaped loop can be moved together with a slide 53 and with the upper and lower cutting device 52.

Figure 8:
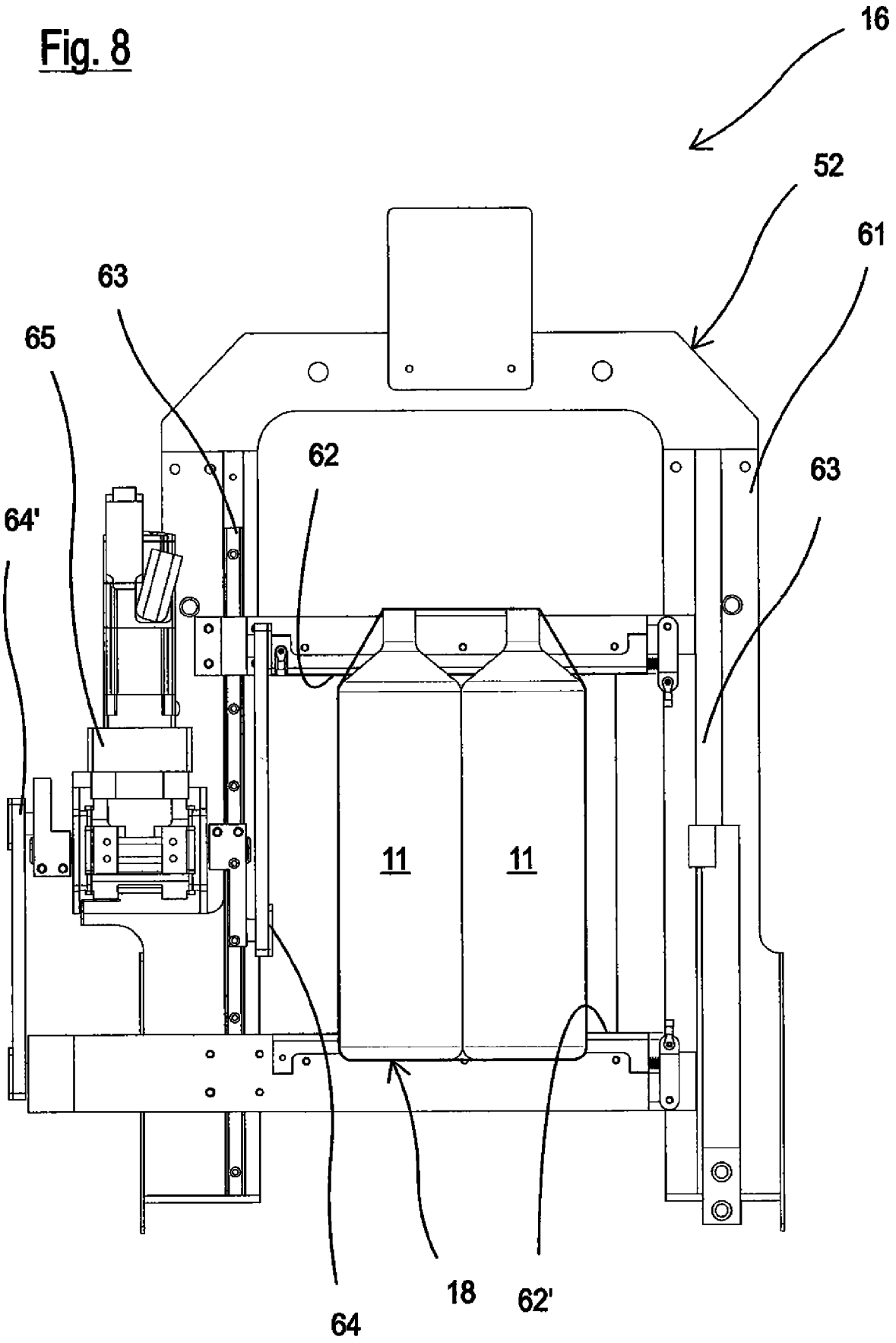
FIGS. 8 and 9 show sectional views in correspondence with the cutting unit with the upper and lower blades and side blades respectively, in an operating position acting on the film of plastic material that is enveloping the products.
Figure 9:
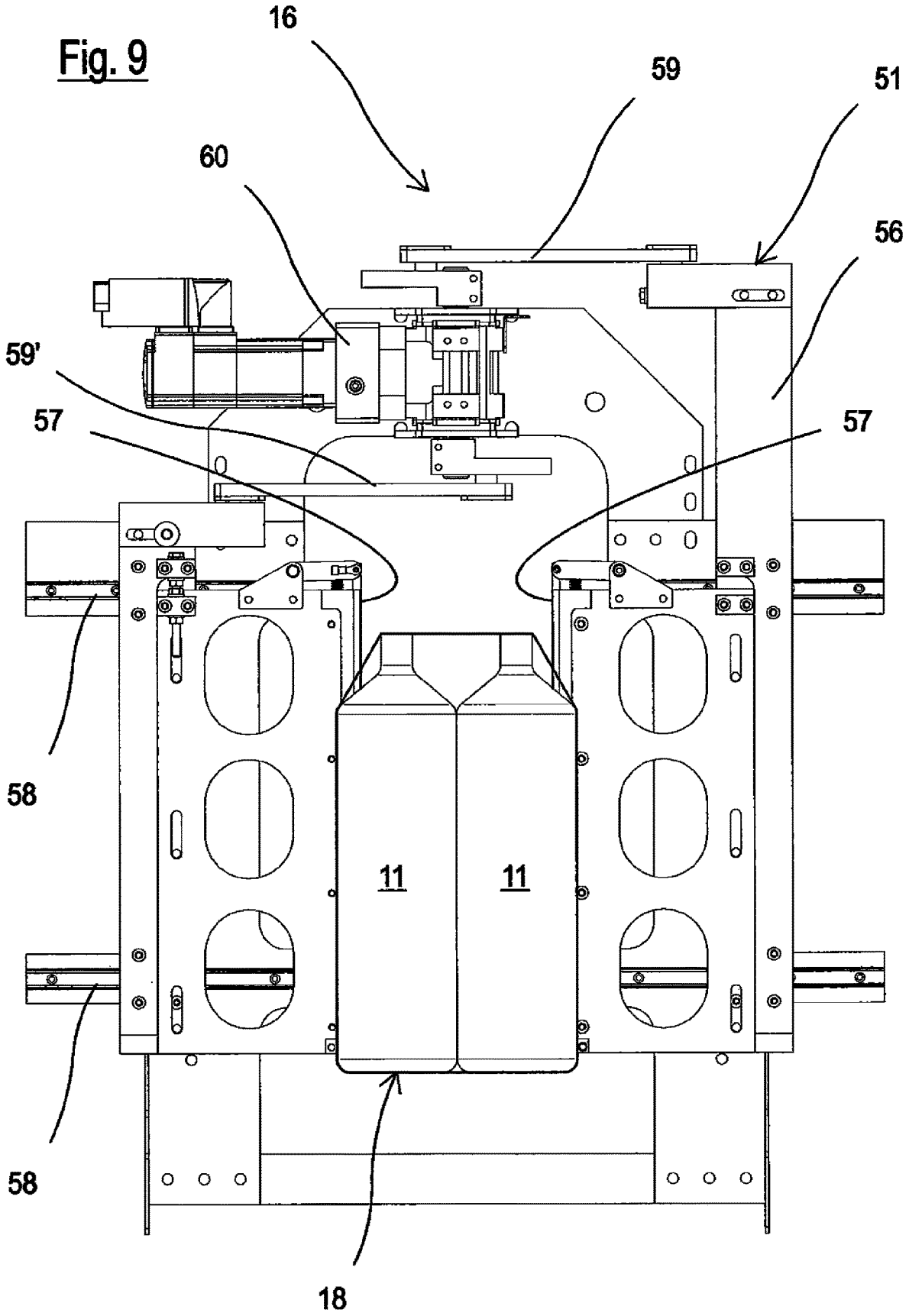

FIGS. 8 and 9 respectively show sectional views in correspondence with the upper and lower cutting device 52 of the cutting unit 16 with the upper 62 and lower 62' horizontal blades and the side cutting device 51 with the vertical side blades 57 in an operational position acting on the film of plastic material that is being wound around the products.

The reciprocal distance d between the two portals 56 and 61 of the two side 51 and upper and lower 52 cutting devices is variable and adjustable in the setting phase with both a variation in the dimensions of the bottles 11 or other products being packaged above all in the quantity of bottles 11 or products required in the final packaging to be obtained. For this purpose, adjustable struts/rods 68 connect the two portals 56 and 61 of the two cutting devices 51 and 52 so that the reciprocal distance can be varied and regulated. With this arrangement, finished packagings can therefore be produced, for example with four or six bottles or another number or different dimensions.

It is evident that with a cutting unit of this type, a new method for cutting a continuous packaging of products is also provided.

This new cutting method in a packaging machine of products 11 in extensible film fed forwards in continuum comprises a step of feeding products wound in a continuous packaging or bundle of products to a cutting unit and cutting the continuous packaging, by means of the cutting unit, into finished groups of products 11 arranged in the above-mentioned extensible film.

This method comprises the step of cutting the above-mentioned continuous packaging or bundle of products with at least one movable cutting device which is moved forwards at the same advance rate as the continuous packaging or bundle of products to be cut.

The cutting step is implemented by effecting, in a new and original manner, with the at least one movable cutting device in movement, a transversal perimetric cutting of the continuous packaging or bundle of products that is moving forwards. This is followed by the step of bringing the movable cutting device back with respect to the continuous packaging or bundle of products that is moving forwards and effecting a new step analogous to the previous one. The method naturally comprises repeating these last two steps for the whole continuous packaging or bundle of products that is moving forwards for the number of times necessary for completing the packaging of all the desired products.

The products, such as bottles, are preferably ordered in two continuous rows of adjacent products 11.

The perimetric cutting step is preferably implemented by effecting a cutting on four sections of the continuous packaging, two vertical and two horizontal, which form the perimeter of the continuous packaging.

According to the invention, the complete perimetric cutting on the packaging or bundle is effected in two consecutive steps. Each step for cutting the continuous packaging or bundle of products that is moving forwards is effected simultaneously in two points of the packaging or bundle. The two points are arranged at the above-mentioned distance d from each other, that is equal to a finished packaging 18.

In a first point of the packaging or bundle, the cutting is effected of two vertical sections and two horizontal sections are cut in a second point of the packaging or bundle so that by consecutively repeating this step of cutting the continuous packaging or bundle of products simultaneously in these two points, a finished packaging is created.

The functioning of a cutting unit according to the invention in a packaging machine in extensible film of products fed in continuous is as follows.

Once a continuous packaging or bundle containing products, such as pairs of bottles, has been produced in the packaging machine, said packaging is sent to the cutting unit.

Said continuous packaging or bundle of pairs of bottles 11, produced, for example, with intersecting layers of extensible film but not exclusively in this way, passes onto the conveyor belt 55. The conveyor belt 55 of the cutting unit 16 supports and accompanies the continuous packaging or bundle during the complete cutting step.

More specifically, the slide 53 containing the two side 51 and upper and lower 52 cutting devices moves to correlate with the advancement rate of the continuous bundle on the conveyor belt 55. The cutting is effected by the two devices when the relative rate between the slide 53 and bundle containing the bottles 11 is zero.

During a cutting step, the vertical side blades 57 of the side cutting device 51 act on a section of the continuous packaging or bundle, whereas the two upper and lower 62' horizontal blades of the upper and lower cutting device 52 act on a different section of the continuous packaging or bundle.

The completion and separation of the finished packaging is effected when, as the continuous bundle continues to move forwards, the slide 53 has brought the cutting devices 51 and 52 back, which in the meantime have become disengaged from the packaging. The slide is then reactivated in the advance direction of the continuous bundle returning to the same advance rate as the continuous bundle. It is in this situation, in fact, that the two cutting devices 51 and 52 re-operate and effect the respective perimetric vertical and horizontal cuts on the bundle in those sections where cuts had previously been effected in a different direction. The cutting of these further perimetric horizontal and vertical sections completes the perimetric cutting of the continuous packaging, separating the single packaging.

The correct cutting of the continuous packaging to form finished packagings having the desired and required size is therefore effected by means of two repeated consecutive steps on the continuous packaging at a longitudinal distance equal to that of a finished packaging containing the desired number of products.

As this type of perimetric cutting involves a short run of the blades that effect the cutting, it requires extremely reduced times.

The objective mentioned in the preamble of the description has therefore advantageously been achieved.

A cutting method and unit are in fact provided with particularly reduced intervention times. Both the cutting method and the cutting unit advantageously use an extensible film which is particularly resistant and light with a considerable saving of material.

Furthermore there is no need for heat-shrinking, with an energy saving, as once it has been wound around the products with a certain tension, it maintains the form of the packaging thus formed.

One or more cutting units can also be provided, for example, within a packaging machine, with an increase in the hourly productivity.

The forms of the structure for the provision of a cutting unit and cutting method of the present invention, as also the materials and assembly modes, can naturally differ from those shown for purely illustrative and non-limiting purposes in the drawings.

The protection scope of the present invention is defined by the enclosed claims.

The invention claimed is:

1. A cutting method implemented in a packaging machine of products wrapped in extensible film, comprising the following steps:

feeding the products, wound in a continuous packaging, to a cutting unit; and cutting, with said cutting unit, said continuous packaging into finished groups of products arranged in said extensible film, wherein said cutting comprises:

effecting said cutting of said continuous packaging with a movable cutting device of said cutting unit, said movable cutting device being moved in a same direction of movement as the continuous packaging at a same advance rate as said continuous packaging to be cut, and effecting, with said movable cutting device in movement, a transversal cut of a perimeter of said continuous packaging which is moving; and in a subsequent step, bringing said movable cutting device back with respect to the direction of movement of said continuous packaging and effecting a new cutting step with said cutting unit, wherein said cutting step of said continuous packaging that is moving is effected simultaneously by said movable cutting device in two locations of said continuous packaging, said two locations being at a distance from each other, in the direction of movement of said continuous packaging, wherein in a first location of said continuous packaging, the cutting is effected at two vertical locations, and wherein at two horizontal locations the cutting is made in a second location of said continuous packaging so that, by consecutively repeating the cutting of the continuous packaging simultaneously in said two locations, a finished packaging is created.

2. A packaging machine comprising:

a cutting unit adapted to separate a series of finished packagings of a predetermined number of products from a continuous packaging wrapped in an extensible film containing the products, the continuous packaging moving in a direction of movement, wherein the cutting unit comprises, a slide moving forward and backward along the direction of movement of said continuous packaging, and a side cutting device, and an upper and lower cutting device, the side cutting device and the upper and lower cutting device being supported by the slide, wherein said side cutting device and said upper and lower cutting device are spaced from each other by a distance measured along the direction of movement of said continuous packaging, said distance being equal to a length along the direction of movement of a finished packaging, said side cutting device and said upper and lower cutting device acting simultaneously on said continuous packaging that is moving to effect a cutting in two positions of said continuous packaging which are at said distance from each other, wherein in a first position of said continuous packaging, the cutting is effected on two vertical sections, and wherein two horizontal sections are cut in a second position of said continuous packaging.

3. The packaging machine according to claim 2, wherein said slide is positioned on guides and moves forwards and backwards along the direction of movement beneath a conveyor belt, which supports said continuous packaging.

4. The packaging machine according to claim 2, wherein said side cutting device comprises a portal containing two vertical side blades movably positioned on horizontal guides for moving towards and away from said continuous packaging, said continuous packaging comprising two layers of film wound in an opposite direction around said products, said side cutting device cutting on two vertical sections of said continuous packaging on opposite sides of said continuous packaging.

5. The packaging machine according to claim 4, wherein said vertical side blades are driven by a double crank mechanism actuated by a single motor.

6. The packaging machine according to claim 2, wherein said upper and lower cutting device comprises a portal having upper and lower horizontal blades movably positioned on vertical guides to move on a vertical plane towards and away from said continuous packaging to effect a cutting on the two horizontal sections of said continuous packaging on opposite sides of said continuous packaging.

7. The packaging machine according to claim 6, wherein said upper and lower horizontal blades are driven by a double crank mechanism actuated by a single motor.

8. The packaging machine according to claim 7, wherein a lower horizontal blade of said upper and lower horizontal blades moves in a loop formed in relation to a belt of said cutting unit, and wherein said loop is movable together with said slide and said upper and lower cutting device.

* * * * *